US009464850B2

(12) United States Patent
Iino et al.

(10) Patent No.: US 9,464,850 B2
(45) Date of Patent: Oct. 11, 2016

(54) HEAT EXCHANGER

(75) Inventors: Yusuke Iino, Isesaki (JP); Yuuichi Matsumoto, Isesaki (JP)

(73) Assignee: SANDEN HOLDINGS CORPORATION, Isesaki-shi (JP)

( * ) Notice: Subject to any disclaimer, the term of this patent is extended or adjusted under 35 U.S.C. 154(b) by 344 days.

(21) Appl. No.: 13/979,511

(22) PCT Filed: Jan. 10, 2012

(86) PCT No.: PCT/JP2012/050240

§ 371 (c)(1),
(2), (4) Date: Jul. 12, 2013

(87) PCT Pub. No.: WO2012/096252

PCT Pub. Date: Jul. 19, 2012

(65) Prior Publication Data

US 2013/0284400 A1 Oct. 31, 2013

(30) Foreign Application Priority Data

Jan. 12, 2011 (JP) ..... 2011-003965

(51) Int. Cl.

| | |
|---|---|
| ***F28D 1/00*** | (2006.01) |
| ***F28D 1/04*** | (2006.01) |
| ***F28F 1/32*** | (2006.01) |
| ***F28F 1/00*** | (2006.01) |
| ***F28D 1/053*** | (2006.01) |
| ***F28F 9/02*** | (2006.01) |
| ***F25B 39/04*** | (2006.01) |
| *F25B 40/02* | (2006.01) |
| *F28D 21/00* | (2006.01) |

(52) U.S. Cl.

CPC ..... *F28F 1/00* (2013.01); *F25B 39/04* (2013.01); *F28D 1/05375* (2013.01); *F28F 9/0253* (2013.01); *F25B 40/02* (2013.01); *F25B 2339/044* (2013.01); *F28D 2021/0084* (2013.01)

(58) Field of Classification Search

CPC .. F25B 39/04; F25B 40/02; F25B 2339/044; F28D 1/05375; F28D 1/0408; F28D 1/0417; F28F 1/12; F28F 1/24; F28F 9/0202; F28F 9/0209

USPC ..... 165/148, 76, 150, 151, 153, 171

See application file for complete search history.

(56) References Cited

U.S. PATENT DOCUMENTS

| | | | | |
|---|---|---|---|---|
| 5,458,190 | A * | 10/1995 | Sasaki et al. | 165/110 |
| 5,546,761 | A * | 8/1996 | Matsuo et al. | 62/509 |
| 5,875,650 | A * | 3/1999 | Nobuta et al. | 62/509 |
| 5,988,267 | A * | 11/1999 | Park et al. | 165/110 |
| 6,871,508 | B2 * | 3/2005 | Wanami | B60H 1/00535 62/196.4 |

(Continued)

FOREIGN PATENT DOCUMENTS

| | | |
|---|---|---|
| JP | 6-194005 | 7/1994 |
| JP | 10-300285 | 11/1998 |

(Continued)

*Primary Examiner* — Frantz Jules
*Assistant Examiner* — Claire Rojohn, III
(74) *Attorney, Agent, or Firm* — Cozen O'Connor

(57) ABSTRACT

A heat exchanger includes a single refrigerant pipe (44) for introducing a refrigerant into a receiver tank (14) from a condenser header part (20, 26), and a mounting member (40) for mounting the receiver tank to a core (10). The mounting member has a refrigerant inlet passage (56) connecting the refrigerant pipe to the interior of the receiver tank, and a refrigerant outlet passage (58) connecting the interior of the receiver tank to a sub-cooler header part (22, 28).

4 Claims, 3 Drawing Sheets

(56) References Cited

U.S. PATENT DOCUMENTS

| | | | | |
|---|---|---|---|---|
| 7,938,173 | B2 * | 5/2011 | Seno et al. | 165/178 |
| 2005/0172664 | A1 * | 8/2005 | Cho et al. | 62/515 |
| 2007/0144713 | A1 * | 6/2007 | Sugimoto | F28D 1/0452 165/140 |
| 2007/0240861 | A1 * | 10/2007 | Kwon | F28D 1/0443 165/140 |
| 2009/0288443 | A1 * | 11/2009 | Lautner et al. | 62/474 |
| 2010/0232110 | A1 * | 9/2010 | Ippoushi | F25B 39/02 361/699 |
| 2013/0126126 | A1 * | 5/2013 | Kim | F25B 39/04 165/104.14 |
| 2013/0306285 | A1 * | 11/2013 | Jindou | F25B 39/00 165/173 |

FOREIGN PATENT DOCUMENTS

| | | |
|---|---|---|
| JP | 2001-174103 | 6/2001 |
| JP | 2007-292377 | 11/2007 |
| JP | 4052706 | 12/2007 |

* cited by examiner

HEAT EXCHANGER

RELATED APPLICATIONS

This is a U.S. national stage of International application No. PCT/JP2012/0050240 filed on Jan. 10, 2012.

This patent application claims the priority of Japanese application no. 2011-003965 filed Jan. 12, 2011, the disclosure content of which is hereby incorporated by reference.

TECHNICAL FIELD

The present invention relates to heat exchangers, and more particularly, to a heat exchanger suited for use as a condenser of an automotive air conditioning system, for example.

BACKGROUND ART

As a heat exchanger of this type, Patent Document 1 discloses a sub-cool type condenser of which a heat exchanger core is constituted by a condenser section for condensing a refrigerant and a sub-cooler section for supercooling the refrigerant of liquid phase obtained by passing the refrigerant from the condenser section to a receiver tank so as to subject the refrigerant to gas-liquid separation, and in which an upper header tank and a lower header tank are connected to each other by a plurality of vertically extending tubes and each have the interior divided by a partition plate into a condenser header part associated with the condenser section and a sub-cooler header part associated with the sub-cooler section.

PRIOR ART DOCUMENT

Patent Document

Patent Document 1: Japanese Patent No. 4052706

SUMMARY OF THE INVENTION

Problems to be Solved by the Invention

In the aforementioned conventional sub-cool type condenser, the receiver tank is arranged between the condenser section and the sub-cooler section, and the inner horizontal end portion of the upper header tank of the condenser section and the inner horizontal end portion of the upper header tank of the sub-cooler section are each closed with a side lid. The upper header tank of the condenser section is connected to the receiver tank by an inlet pipe, and the receiver tank is connected to the upper header tank of the sub-cooler section by an outlet pipe. Further, the inner horizontal end portion of the lower header tank of the condenser section and the inner horizontal end portion of the lower header tank of the sub-cooler section are coupled to each other by a coupling member.

This condenser requires an increased number of components and is complex in structure, and accordingly, a problem arises in that the weight, size and production cost of the condenser increase.

Also, where the heat transfer area of the sub-cooler section needs to be varied because of change of vehicle type, for example, it is necessary that not only the length of the upper and lower header tanks and the positions of the side lids but also the locations of the junctions where the inlet and outlet pipes are connected to the upper header tank should be changed. The aforementioned conventional condenser is therefore associated with a problem that it requires substantial overall modification of the configuration and thus lacks versatility.

The present invention provides a heat exchanger which is reduced in weight, size and cost and is also high in productivity and versatility.

Means for Solving the Problems

According to the present invention, there is provided a heat exchanger which includes a heat exchanger core constituted by a condenser section configured to condense a refrigerant and a sub-cooler section configured to supercool the refrigerant of liquid phase obtained by passing the refrigerant from the condenser section to a receiver tank so as to subject the refrigerant to gas-liquid separation, and in which an upper header tank and a lower header tank are connected to each other by a plurality of vertically extending tubes and each have an interior divided by a partition plate into a condenser header part associated with the condenser section and a sub-cooler header part associated with the sub-cooler section, the heat exchanger comprising: a single refrigerant pipe configured to introduce the refrigerant into the receiver tank from the condenser header part; and a mounting member configured to mount the receiver tank to the core, wherein the mounting member has a refrigerant inlet passage connecting the refrigerant pipe to an interior of the receiver tank and a refrigerant outlet passage connecting the interior of the receiver tank to the sub-cooler header part.

Preferably, the mounting member covers an upper end portion of the receiver tank.

Preferably, the mounting member covers a horizontal end portion of the sub-cooler header part.

Preferably, the mounting member has a retainer provided in the inlet passage and configured to prevent detachment of the refrigerant pipe.

Advantageous Effects of the Invention

The heat exchanger of the present invention includes the single refrigerant pipe for introducing the refrigerant into the receiver tank from the condenser header part and the mounting member permitting the receiver tank to be mounted to the core, and the mounting member has the refrigerant inlet passage connecting the refrigerant pipe to the interior of the receiver tank and the refrigerant outlet passage connecting the interior of the receiver tank to the sub-cooler header part. Thus, the refrigerant flow channel between the header tank and the receiver tank can be constituted by two members, namely, the single refrigerant pipe and the mounting member. Since the number of components of the heat exchanger can be reduced, it is possible to reduce the weight, size and cost of the heat exchanger and also to increase productivity.

Further, the heat transfer area of the sub-cooler section of the core can be easily varied by just changing the location of the junction where the refrigerant pipe is connected to the condenser header part and the position of the partition plate, making it possible to substantially expand the versatility of the heat exchanger.

Also, according to the present invention, the mounting member covers the upper end portion of the receiver tank, so that the mounting member serves not only as the refrigerant inlet and outlet passages for the receiver tank but also as the upper lid for the receiver tank. It is therefore possible to further reduce the weight, size and cost of the heat exchanger and also to increase productivity.

Further, according to the present invention, the mounting member covers the horizontal end portion of the sub-cooler header part, so that the mounting member serves not only as the refrigerant inlet and outlet passages for the receiver tank and the upper lid for the receiver tank, but also as the side lid for the header tank. It is therefore possible to further reduce the weight, size and cost of the heat exchanger and to raise productivity.

According to the present invention, moreover, the mounting member has a retainer provided in the inlet passage and configured to prevent detachment of the refrigerant pipe. Thus, the mounting member serves as the refrigerant inlet and outlet passages, as the upper lid for the receiver tank and as the side lid for the header tank, and also serves to engage with the refrigerant pipe to hold same in position. It is therefore possible to further reduce the weight, size and cost of the heat exchanger and to increase productivity.

MODE OF CARRYING OUT THE INVENTION

An external heat exchanger 1, which is a heat exchanger embodying the present invention, will be described below with reference to the accompanying drawings.

Figure 1:
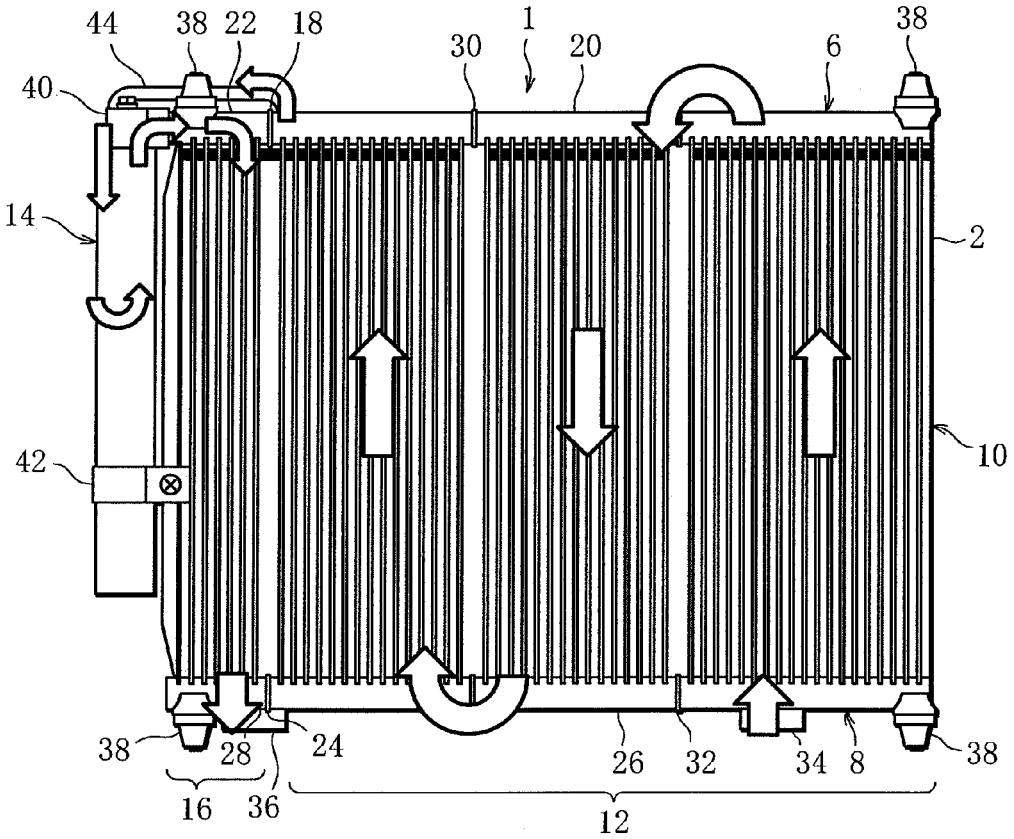
FIG. 1 is a front view of an external heat exchanger according to one embodiment of the present invention.

FIG. 1 is a front view of the external heat exchanger 1. The external heat exchanger 1 is incorporated, for example, into a heat pump cycle of an automotive air conditioning system, not shown, and is used as an evaporator when the air conditioning system is operating in heating mode. The external heat exchanger 1 has a multi-flow structure including a large number of vertical tubes 2 through which a refrigerant flows, such that the drainage of water condensed on the surfaces of the tubes 2 is enhanced to thereby restrain the formation of frost on the tubes 2 at low ambient temperatures. Fins 4 (see FIG. 3) are joined to adjacent ones of the tubes 2 to promote transfer of heat with respect to the ambient air currents.

Each tube 2 has an upper end connected to an upper header tank 6 and has a lower end connected to a lower header tank 8. The interior of the upper header tank 6 communicates with the interior of the lower header tank 8 through the individual tubes 2.

A core 10, which performs a heat transfer function of the external heat exchanger 1, is divided into a condenser section 12 where the high-temperature, high-pressure gas refrigerant supplied from a compressor (not shown) turns into a gas-liquid two-phase state due to the transfer of heat with respect to the ambient air, and a sub-cooler section 16 where the refrigerant of liquid phase is supercooled, the liquid refrigerant being obtained by passing the gas-liquid refrigerant from the condenser section 12 to a receiver tank 14, described later, so as to subject the refrigerant to gas-liquid separation.

The interior of the upper header tank 6 is divided by a partition plate 18 into an upper condenser header part 20 and an upper sub-cooler header part 22. The interior of the lower header tank 8 is divided by a partition plate 24 into a lower condenser header part 26 and a lower sub-cooler header part 28.

In the condenser section 12, the upper and lower condenser header parts 20 and 26 are provided with partition plates 30 and 32, respectively, which are located above and below and shifted in a horizontal direction. An inlet port 34 for introducing the refrigerant into the condenser section 12 is provided on a portion of the lower header tank 8 to the right of the partition plate 32 as viewed in FIG. 1. An outlet port 36 for letting out the refrigerant from the sub-cooler section 16 is provided on a portion of the lower header tank 8 to the left of the partition plate 24 as viewed in FIG. 1.

Mounting portions 38 protrude from the respective opposite ends of each of the upper and lower header tanks 6 and 8 to permit the external heat exchanger 1 to be mounted on a vehicle body. The receiver tank 14 is attached to the left-hand side of the sub-cooler section 16, as viewed in FIG. 1, by an upper mounting member (mounting member) 40 and a lower mounting member 42. The external heat exchanger 1 constitutes what is called a sub-cool type condenser.

Figure 2:
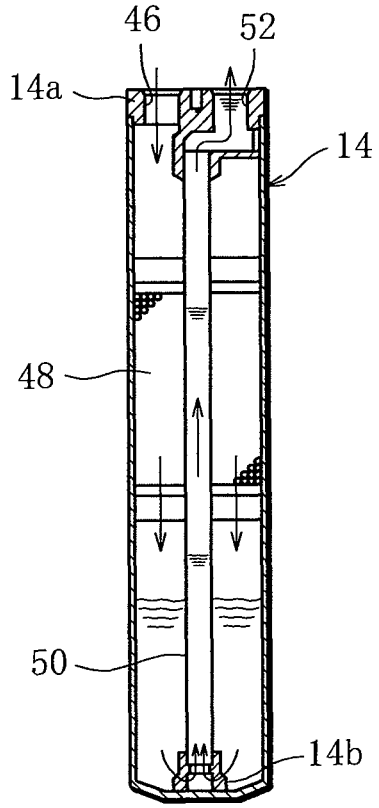
FIG. 2 is a sectional view of a receiver tank shown in FIG. 1.

FIG. 2 is a sectional view of the receiver tank 14. A single refrigerant pipe 44 extends from the upper condenser header part 20 and is connected to a refrigerant inlet opening 46 which penetrates through an upper end portion 14*a* of the receiver tank 14, as described in detail later. A filter 48 is arranged within the receiver tank 14. A liquid flow pipe 50, which is also arranged inside the receiver tank 14, opens near a bottom 14*b* of the receiver tank 14 and is connected to a refrigerant outlet opening 52 which penetrates through the upper end portion 14*a* of the receiver tank 14.

The refrigerant that has been condensed into the gas-liquid two-phase state in the condenser section 12 flows through the refrigerant pipe 44 into the receiver tank 14 via the inlet opening 46, and because of gravity, only the liquid refrigerant passes through the filter 48 and flows down to be stored in the receiver tank 14. The stored liquid refrigerant is pushed upward through the liquid flow pipe 50 by the pressure of the gas refrigerant and flows out of the outlet opening 52 into the sub-cooler section 16.

Figure 3:
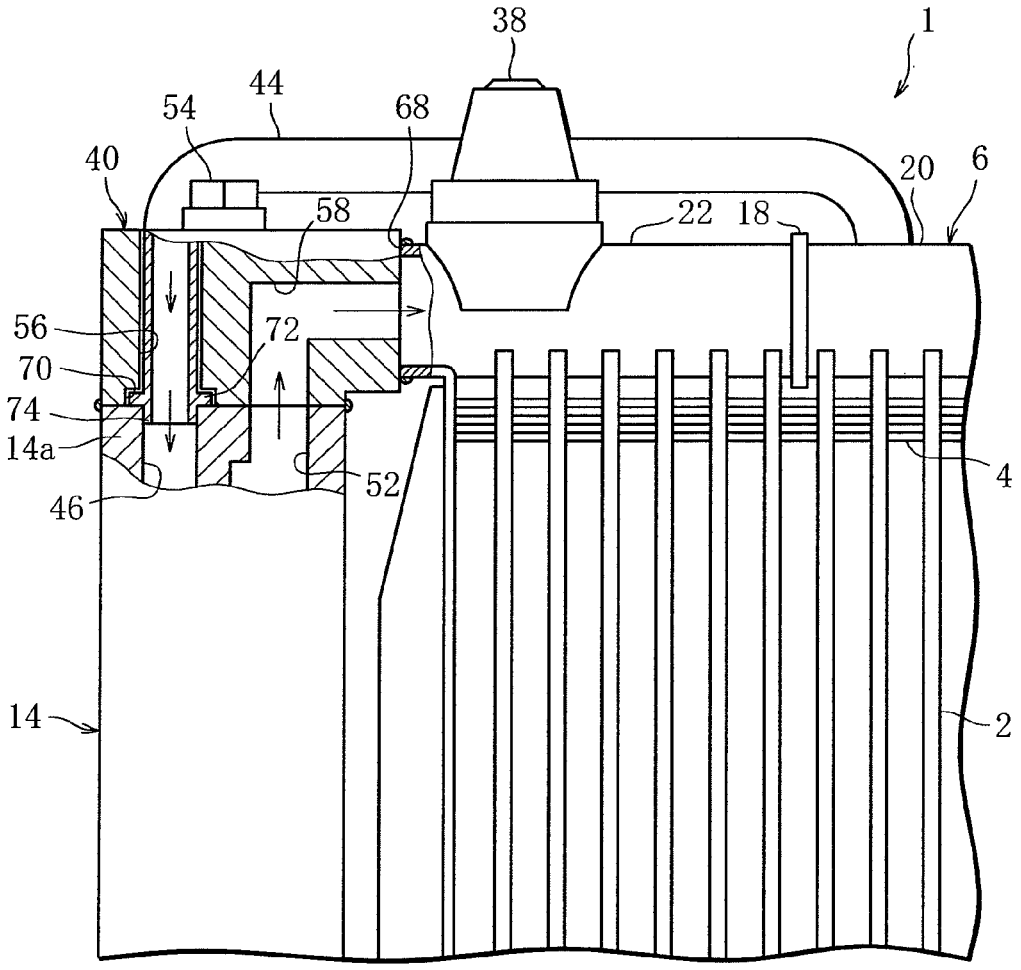
FIG. 3 is a partially cutaway enlarged view showing a refrigerant pipe and an upper mounting member, both shown in FIG. 1.

FIG. 3 is a partially cutaway enlarged view showing the refrigerant pipe 44 and the upper mounting member 40. The upper mounting member 40 is securely fastened to the upper end portion 14*a* of the receiver tank 14 by a bolt 54. The upper mounting member 40 has an insertion hole (inlet passage) 56 formed therein, into which the refrigerant pipe 44 is inserted from a slit, not shown, formed in a side portion of the upper mounting member 40, and has a refrigerant outlet passage 58 formed therein to connect the interior of the receiver tank 14 to the sub-cooler header part 22 through the outlet opening 52.

The upper mounting member 40 serves as an upper lid for covering the upper end portion 14*a* of the receiver tank 14, with the junction between the insertion hole 56 and the inlet opening 46 and between the outlet passage 58 and the outlet opening 52 gastightly connected by a suitable sealing-connection means, such as brazing, while allowing passage of the refrigerant.

Also, the upper mounting member 40 serves as a side lid for covering a horizontal end portion 68 of the sub-cooler header part 22 of the upper header tank 6, with the junction between the outlet passage 58 and the sub-cooler header part 22 gastightly connected by a suitable sealing-connection means, such as brazing, while allowing passage of the refrigerant.

The insertion hole 56 has an increased-diameter portion (retainer) 70 located at the junction where the insertion hole 56 adjoins the upper end portion 14*a*. The increased-diameter portion 70 is fitted for engagement with an enlarged part 72, or a flange, formed near the upper mounting member-side end of the refrigerant pipe 44, and an open end portion 74 of the refrigerant pipe 44 is inserted into the inlet opening 46. Thus, the refrigerant pipe 44 is fixed to the upper mounting member 40 in such a manner that the former is prevented from coming off the latter, whereby a gastight refrigerant inlet passage is formed which extends through the upper mounting member 40 from the refrigerant pipe 44 to the interior of the receiver tank 14.

As described above, according to the embodiment, the refrigerant flow channel between the upper header tank 6 and the receiver tank 14 can be constituted by two members, that is, the single refrigerant pipe 44 and the upper mounting member 40. Accordingly, the number of components of the external heat exchanger 1 can be substantially reduced, making it possible to reduce the weight, size and cost of the external heat exchanger 1 and also to increase productivity.

Further, the heat transfer area of the sub-cooler section 16 of the core 10 can be easily varied by just changing the location where the refrigerant pipe 44 is connected to the condenser header part 20 and the position of the partition plate 18, whereby versatility of the external heat exchanger 1 can be significantly expanded.

Also, the upper mounting member 40 serves not only as the refrigerant inlet passage for the receiver tank 14, that is, the insertion hole 56 for the refrigerant pipe 44, as well as the refrigerant outlet passage 58, but also as the upper lid for the receiver tank 14, the side lid for the upper header tank 6, and the engagement member for preventing detachment of the refrigerant pipe 44. It is therefore possible to further reduce the weight, size and cost of the external heat exchanger 1 and enhance productivity.

While the embodiment of the present invention has been described above, it is to be noted that the present invention is not limited to the foregoing embodiment and may be modified in various ways without departing from the scope of the invention.

In the above embodiment, for example, the refrigerant flow channel between the upper header tank 6 and the receiver tank 14 is constituted by two members, namely, the single refrigerant pipe 44 and the upper mounting member 40, in order to reduce the weight, size and cost of the external heat exchanger 1 as well as to increase productivity, and also change of the heat transfer area of the sub-cooler section 16 is facilitated so that efforts to change design and modify configuration, where required, can be minimized. The construction and application of the external heat exchanger 1 are not limited to those explained above insofar as these advantages are obtained.

EXPLANATION OF REFERENCE SIGNS

1: external heat exchanger (heat exchanger)
2: tube
6: upper header tank (header tank)
8: lower header tank (header tank)
10: core
12: condenser section
14: receiver tank
16: sub-cooler section
18: partition plate
20: upper condenser header part (condenser header part)
22: upper sub-cooler header part (sub-cooler header part)
24: partition plate
26: lower condenser header part (condenser header part)
28: lower sub-cooler header part (sub-cooler header part)
44: refrigerant pipe
40: upper mounting member (mounting member)
56: insertion hole (inlet passage)
58: outlet passage
14*a*: upper end portion
68: horizontal end portion
70: increased-diameter portion (retainer)

The invention claimed is:

1. A heat exchanger which includes a heat exchanger core constituted by a condenser section configured to condense a refrigerant and a sub-cooler section configured to supercool the refrigerant of liquid phase obtained by passing the refrigerant from the condenser section to a receiver tank so as to subject the refrigerant to gas-liquid separation, and in which an upper header tank and a lower header tank are connected to each other by a plurality of vertically extending tubes and each have an interior divided by a partition plate into a condenser header part associated with the condenser section and a sub-cooler header part associated with the sub-cooler section, the heat exchanger comprising:

a single refrigerant pipe configured to introduce the refrigerant into the receiver tank from the condenser header part; and a mounting member configured to mount the receiver tank to the upper header tank, wherein the mounting member has a refrigerant inlet passage connecting the refrigerant pipe to an interior of the receiver tank and a refrigerant outlet passage connecting the interior of the receiver tank to the sub-cooler header part, a location of a junction where the refrigerant pipe is connected to the condenser header part is adjustable, and a position of the partition plates of the header tanks is adjustable.

2. The heat exchanger according to claim 1, wherein the mounting member covers an upper end portion of the receiver tank.

3. The heat exchanger according to claim 2, wherein the mounting member covers a horizontal end portion of the sub-cooler header part.

4. The heat exchanger according to claim 3, wherein the mounting member has a retainer provided in the inlet passage and configured to prevent detachment of the refrigerant pipe.

* * * * *